US009284864B2

(12) United States Patent
Manther et al.

(10) Patent No.: US 9,284,864 B2
(45) Date of Patent: Mar. 15, 2016

(54) SWITCHING ROLLER FINGER FOLLOWER WITH LOCKING MECHANISM

(71) Applicant: Schaeffler Technologies GmbH & Co. KG, Herzogenaurach (DE)

(72) Inventors: Debora Manther, Royal Oak, MI (US); Rainer Pfeufer, Hagenbuechach (DE); Matthias Kapp, Oak Park, MI (US)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 137 days.

(21) Appl. No.: 14/263,150

(22) Filed: Apr. 28, 2014

(65) Prior Publication Data

US 2014/0331950 A1 Nov. 13, 2014

Related U.S. Application Data

(60) Provisional application No. 61/820,971, filed on May 8, 2013.

(51) Int. Cl.

| | |
|---|---|
| ***F01L 1/34*** | (2006.01) |
| ***F01L 13/00*** | (2006.01) |
| ***F01L 1/18*** | (2006.01) |

(52) U.S. Cl.

CPC ..... *F01L 13/0005* (2013.01); *F01L 1/18* (2013.01); *F01L 2001/186* (2013.01); *F01L 2105/00* (2013.01); *Y10T 29/49247* (2015.01)

(58) Field of Classification Search

CPC ..... F01L 2105/00; F01L 1/185; F01L 1/182; F01L 1/18; F01L 2001/186; F01L 1/2416; F01L 1/181; Y10T 74/20882; Y10T 29/49247

USPC ..... 123/90.15, 90.16

See application file for complete search history.

(56) References Cited

U.S. PATENT DOCUMENTS

| | | | | |
|---|---|---|---|---|
| 8,267,059 | B2 | 9/2012 | Manther et al. | |
| 9,057,290 | B2 * | 6/2015 | Manther | F01L 1/18 |
| 9,115,609 | B2 * | 8/2015 | Manther | F01L 1/181 |
| 2011/0197842 | A1 * | 8/2011 | Manther | F01L 1/185 123/90.44 |
| 2011/0220050 | A1 * | 9/2011 | Patzold | F01L 1/185 123/90.39 |
| 2015/0053160 | A1 * | 2/2015 | Manther | F01L 13/0036 123/90.39 |

* cited by examiner

*Primary Examiner* — Jesse Bogue
*Assistant Examiner* — Daniel Bernstein
(74) *Attorney, Agent, or Firm* — Simpson & Simpson, PLLC

(57) ABSTRACT

A switching roller finger follower, including: a housing with a first wall with a first opening, a second wall with a second opening, and an interior space at least partially formed by the walls; first and second outer arms; and a locking pin disposed in the openings and including a longitudinal axis, a body, and first and second protrusions extending radially outward from the body, formed of a same piece of material as the body, and at least one of which is located within the space. A respective portion of at least one of the first or second protrusions is aligned with the first or second wall in a direction parallel to the first longitudinal axis. The locking pin is displaceable such that: in a locked mode, the locking pin blocks pivoting of the arms; and in an unlocked mode, the locking pin is free of contact with the arms.

20 Claims, 11 Drawing Sheets

SWITCHING ROLLER FINGER FOLLOWER WITH LOCKING MECHANISM

CROSS-REFERENCE TO RELATED APPLICATIONS

This application claims the benefit under 35 U.S.C. §119 (e) of U.S. Provisional Patent Application No. 61/820,971, filed May 8, 2013, which application is incorporated herein by reference in its entirety.

TECHNICAL FIELD

The present disclosure relates to a switching roller finger follower with a locking mechanism for use with a valve train of an internal combustion engine. In particular the locking mechanism includes a locking pin with integral protrusions arranged to engage the inside or the outside of a housing for the follower to ensure desired positioning of the locking pin. The housing includes openings sized and shaped to accommodate installation of the locking pin.

BACKGROUND

Known switching roller finger followers use a shuttle pin to control position of a locking pin. In a first mode, the locking pin is positioned to contact side arms on the follower to prevent full pivoting of the arms. In a second mode, the locking pin is positioned to be out of the pivoting path of the side arms. Both positions are necessary for typical functioning of the follower. In some instances, the locking pin can be knocked out of alignment, for example, such that in first mode, the pin is no longer in the pivoting path of the side arms and does not prevent full pivoting of the arms. In this case, the functioning of the device connected to the follower, for example, a valve in a valve train, will be adversely affected. Currently, retaining clips are used at the ends of the locking pins to retain locking pins with the housing. Assembly of locking pins requires extra parts and extra operations that are undesirable.

SUMMARY

According to aspects illustrated herein, there is provided a switching roller finger follower, including: a housing with a first wall with a first opening, a second wall with a second opening, and an interior space at least partially formed by the first and second walls; first and second pivotable outer arms; and a locking pin disposed in the first and second openings and including a first longitudinal axis, a body, and first and second protrusions extending radially outward from the body, formed of a same single piece of material as the body, and at least one of which is located within the interior space. A respective portion of at least one of the first or second protrusions is aligned with the first or second wall in a direction parallel to the first longitudinal axis. The locking pin is displaceable such that: in a locked mode, the locking pin contacts the first and second outer arms to block pivoting of the first and second outer arms in a first rotational direction; and in an unlocked mode, the locking pin is free of contact with the first and second outer arms.

According to aspects illustrated herein, there is provided a switching roller finger follower, including: a housing with a first wall with a first opening wholly surrounded by the first wall, a second wall with a second opening wholly surrounded by the second wall, and an interior space at least partially formed by the first and second walls; first and second pivotable outer arms; and a locking pin disposed in the interior space and in first and second openings and including a first longitudinal axis, a body, and first and second protrusions. The protrusions extend radially outward from the body, are formed of a same single piece of material as the body, and at least one is located within the interior space or outside of the first or second wall with respect to the space. A respective portion of one of the first or second protrusions is aligned with the first or second wall in a direction parallel to the first longitudinal axis. The locking pin is displaceable such that: in a locked mode, the locking pin contacts the first and second outer arms to block pivoting of the first and second outer arms in a rotational direction; and in an unlocked mode, the locking pin is free of contact with the first and second outer arms.

According to aspects illustrated herein, there is provided a method of fabricating a switching roller finger follower, including: forming a housing with a first wall with a first opening; a second wall with a second opening, and an interior space at least partially formed by the first and second walls; pivotably connecting first and second outer arms to the housing; forming, of one only single piece of material, a locking pin including a first longitudinal axis, a body, and first and second protrusions extending radially outward from the body; inserting the locking pin through the first and second openings; and aligning respective portions of at least one of the first or second protrusions with the first and second walls in a direction parallel to the first longitudinal axis. The locking pin is displaceable such that: in a locked mode, the locking pin contacts the first and second outer arms to block pivoting of the first and second outer arms in a first rotational direction; and in an unlocked mode, the locking pin is free of contact with the first and second outer arms.

BRIEF DESCRIPTION OF THE DRAWINGS

Various embodiments are disclosed, by way of example only, with reference to the accompanying schematic drawings in which corresponding reference symbols indicate corresponding parts, in which.

DETAILED DESCRIPTION

At the outset, it should be appreciated that like drawing numbers on different drawing views identify identical, or functionally similar, structural elements of the disclosure. It is to be understood that the disclosure as claimed is not limited to the disclosed aspects.

Furthermore, it is understood that this disclosure is not limited to the particular methodology, materials and modifications described and as such may, of course, vary. It is also understood that the terminology used herein is for the purpose of describing particular aspects only, and is not intended to limit the scope of the present disclosure.

Unless defined otherwise, all technical and scientific terms used herein have the same meaning as commonly understood to one of ordinary skill in the art to which this disclosure belongs. It should be understood that any methods, devices or materials similar or equivalent to those described herein can be used in the practice or testing of the disclosure.

Figure 1A:
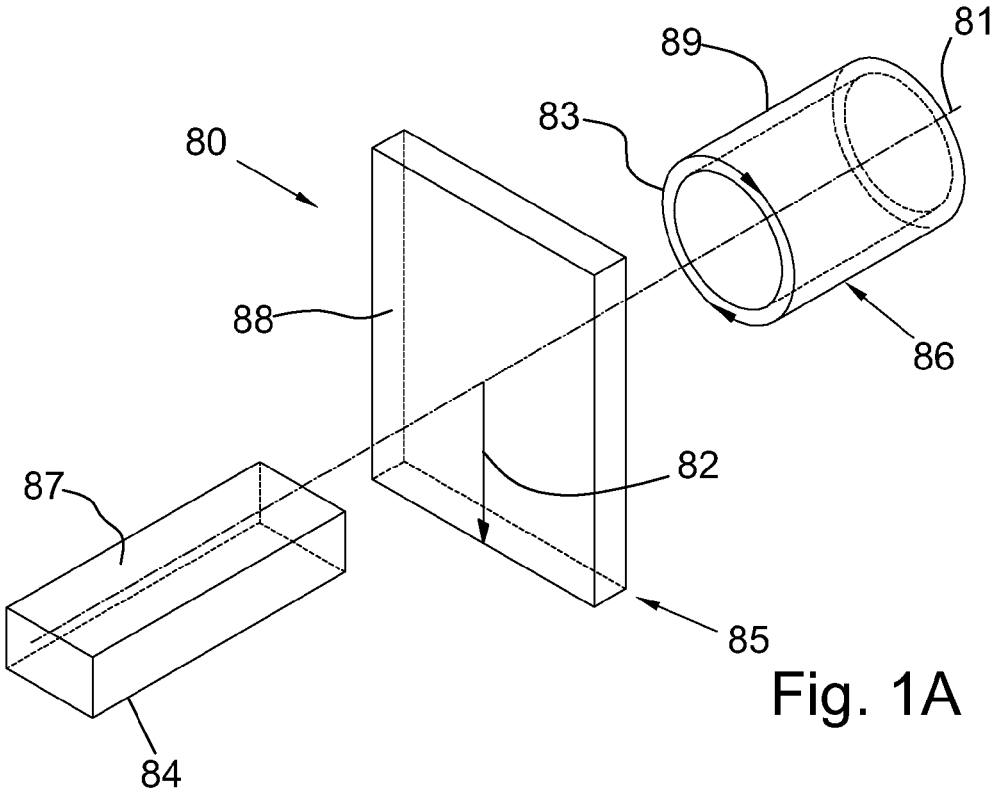
FIG. 1A is a perspective view of a cylindrical coordinate system demonstrating spatial terminology used in the present application.

FIG. 1A is a perspective view of cylindrical coordinate system 80 demonstrating spatial terminology used in the present application. The present invention is at least partially described within the context of a cylindrical coordinate system. System 80 has a longitudinal axis 81, used as the reference for the directional and spatial terms that follow. The adjectives "axial," "radial," and "circumferential" are with respect to an orientation parallel to axis 81, radius 82 (which is orthogonal to axis 81), and circumference 83, respectively. The adjectives "axial," "radial" and "circumferential" also are regarding orientation parallel to respective planes. To clarify the disposition of the various planes, objects 84, 85, and 86 are used. Surface 87 of object 84 forms an axial plane. That is, axis 81 forms a line along the surface. Surface 88 of object 85 forms a radial plane. That is, radius 82 forms a line along the surface. Surface 89 of object 86 forms a circumferential plane. That is, circumference 83 forms a line along the surface. As a further example, axial movement or disposition is parallel to axis 81, radial movement or disposition is parallel to radius 82, and circumferential movement or disposition is parallel to circumference 83. Rotation is with respect to axis 81.

The adverbs "axially," "radially," and "circumferentially" are with respect to an orientation parallel to axis 81, radius 82, or circumference 83, respectively. The adverbs "axially," "radially," and "circumferentially" also are regarding orientation parallel to respective planes.

Figure 1B:
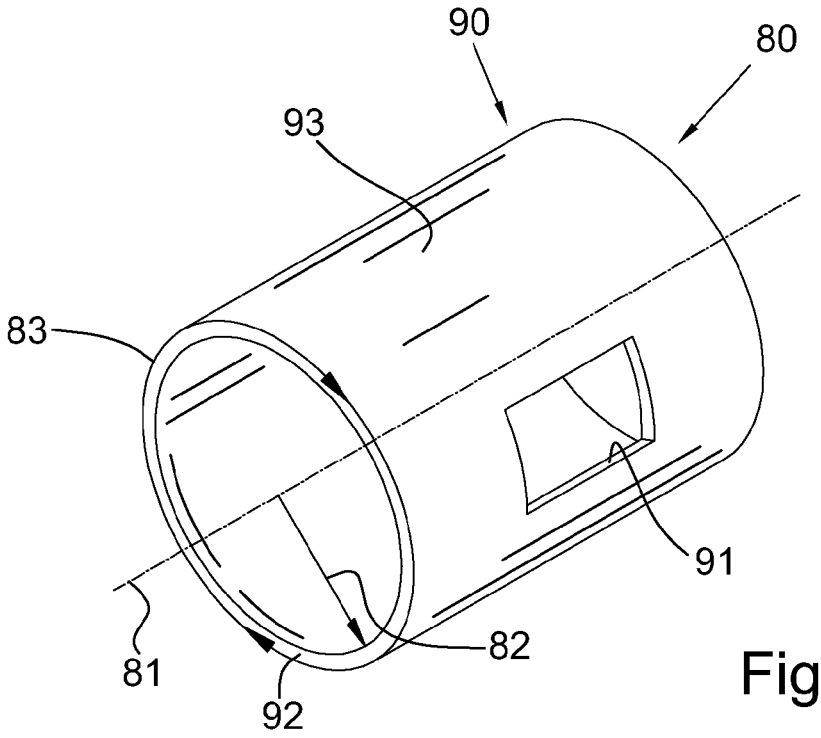
FIG. 1B is a perspective view of an object in the cylindrical coordinate system of FIG. 2A demonstrating spatial terminology used in the present application.

FIG. 1B is a perspective view of object 90 in cylindrical coordinate system 80 of FIG. 1A demonstrating spatial terminology used in the present application. Cylindrical object 90 is representative of a cylindrical object in a cylindrical coordinate system and is not intended to limit the present invention in any manner. Object 90 includes axial surface 91, radial surface 92, and circumferential surface 93. Surface 91 is part of an axial plane, surface 92 is part of a radial plane, and surface 93 is a circumferential surface.

Figure 2A:
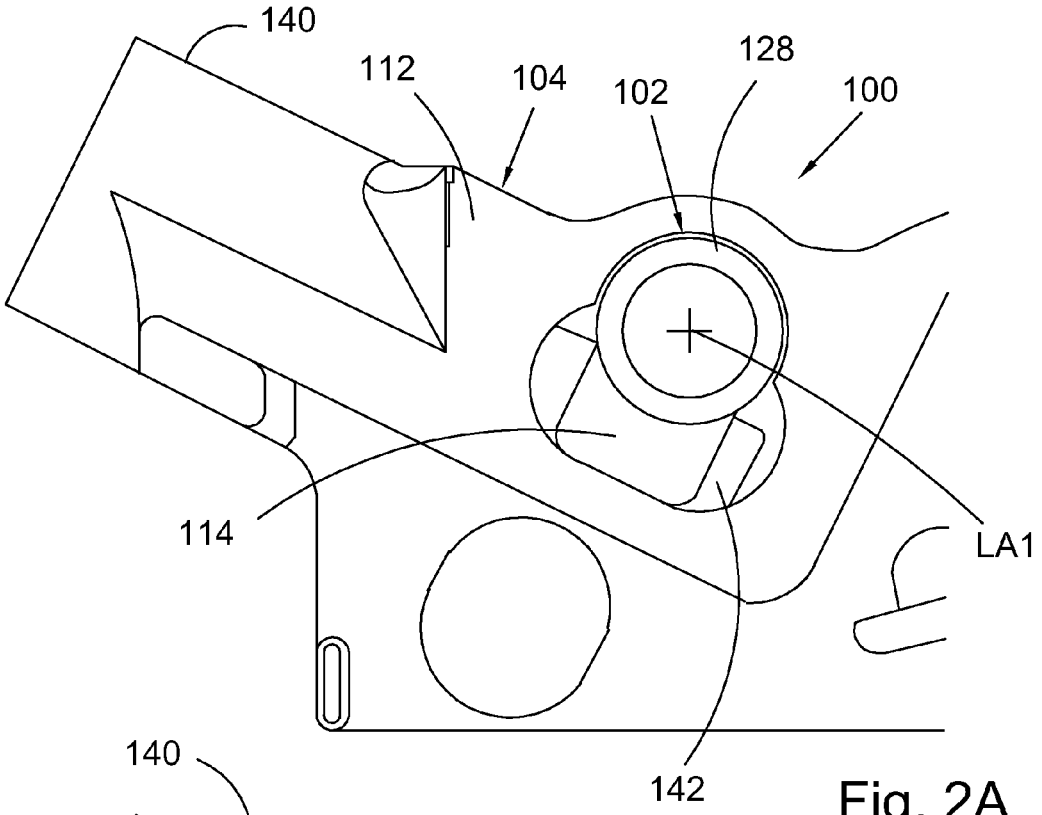
FIG. 2A is a partial side view of a switching roller finger follower with a locking pin being installed.

FIG. 2A is a partial side view of switching roller finger follower 100 with locking pin 102 being installed.

Figure 2B:
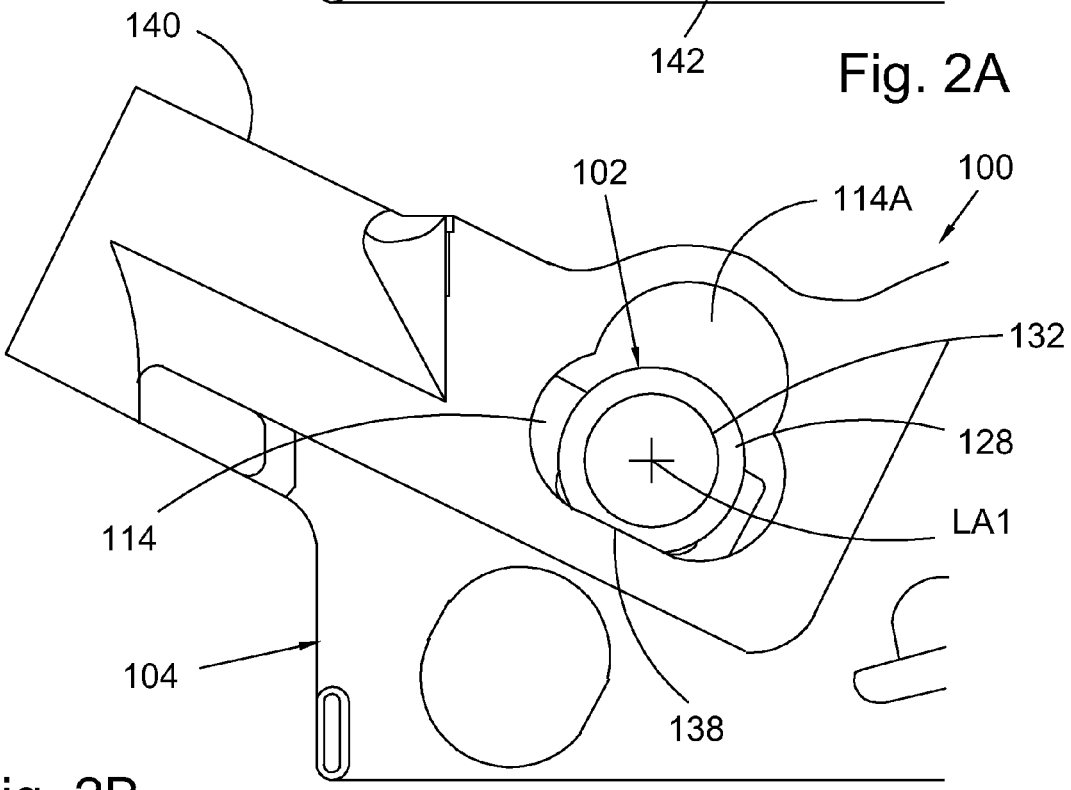
FIG. 2B is a partial side view of the switching roller finger follower in FIG. 2A with the locking pin in place.

FIG. 2B is a partial side view of switching roller finger follower 100 in FIG. 2A with locking pin 102 in place.

Figure 2C:
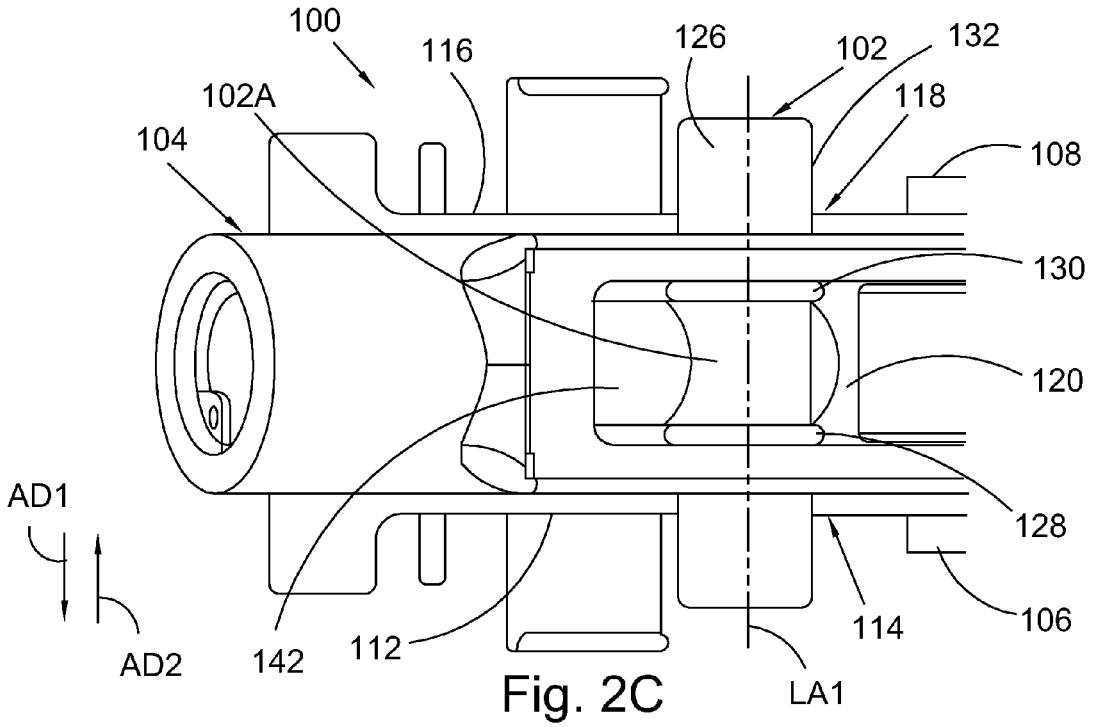
FIG. 2C is a partial top view of the switching roller finger follower in FIG. 2A with the locking pin in place.

FIG. 2C is a partial top view of switching roller finger follower 100 in FIG. 2A with locking pin 102 in place. The following should be viewed in light of FIGS. 2A through 2C. Follower 100 includes housing 104, outer arms 106 and 108, and pin 102. Housing 104 includes wall 112 with opening 114, wall 116 with opening 118, and interior space 120 at least partially formed by walls 112 and 116. Arms 106 and 108 are pivotably connected to walls 112 and 116, respectively. Pin 102 includes longitudinal axis LA1, body 126, and protrusions 128 and 130 extending radially from body 126 and disposed about at least respective portions of circumference 132 of the locking pin. The locking pin passes through openings 114 and 118 and includes portion 102A disposed in space 120. As shown in FIG. 2C and further described below, when installed in the housing, respective portions of protrusions 128 and 130 are aligned with, or alignable with, walls 112 and 116 in directions AD1 and AD2 parallel to axis LA1. In the example embodiment of FIGS. 2A-2C, openings 114 and 118 are wholly surrounded by walls 112 and 116, respectively, that is, openings 114 and 116 are wholly surrounded by respective material forming walls 112 and 116.

Protrusions 128 and 130 are integral to the locking pin, that is, the protrusions and body 126 are formed of a same single piece of material. At least one of protrusions 128 or 130 is located within space 120; or at least one of protrusions 128 or 130 is located outside of space 120. In the example of FIGS. 2A through 2C, both protrusion 128 and 130 are located within space 120, and aligned with walls 112 and 116 in directions AD1 and AD2.

In the example embodiment of FIGS. 2A through 2C, a circumferential extent of protrusions 128 and 130 (about the circumference of the locking pin) is greater than 180 degrees. In the example embodiment of FIGS. 2A through 2C, the circumferential extent of protrusions 128 and 130 (about the circumference of the locking pin) is 360 degrees.

At least one of openings 114 or 118 is sized to enable locking pin 102 and protrusions 128 and/or 130 to be inserted through the opening as shown in FIG. 2A. Once pin 102 is inserted through opening 114 and 118, gravity holds pin 102 in contact with lower edges 138 of openings 114 and 118. for the position shown in FIGS. 2B and 2C. The alignment of protrusions 128 and 130 with walls 112 and 116, respectively, while the protrusions are in space 120, restrains pin 102 in directions AD1 and AD2. Specifically, the alignment between protrusion 128 and wall 112 prevents movement of pin 102 in direction AD1, and the alignment between protrusion 130 and wall 116 prevents movement of pin 102 in direction AD2.

In an example embodiment, housing includes locking barrel 140 and follower 100 includes shuttle pin 142, engaged with pin 102. Protrusions 128 and 130 are aligned with the shuttle pin in directions AD1 and AD2 to provide additional stability. As is known in the art, the locking pin is displaceable via displacement of the shuttle pin such that in a locked mode, the locking pin contacts arms 106 and 108 to block pivoting of arms 106 and 108. In an unlocked mode, the locking pin is displaceable via the shuttle pin such that pin 102 is free of contact with arms 106 and 108 and arms 106 and 108 are free to pivot.

Figure 3A:
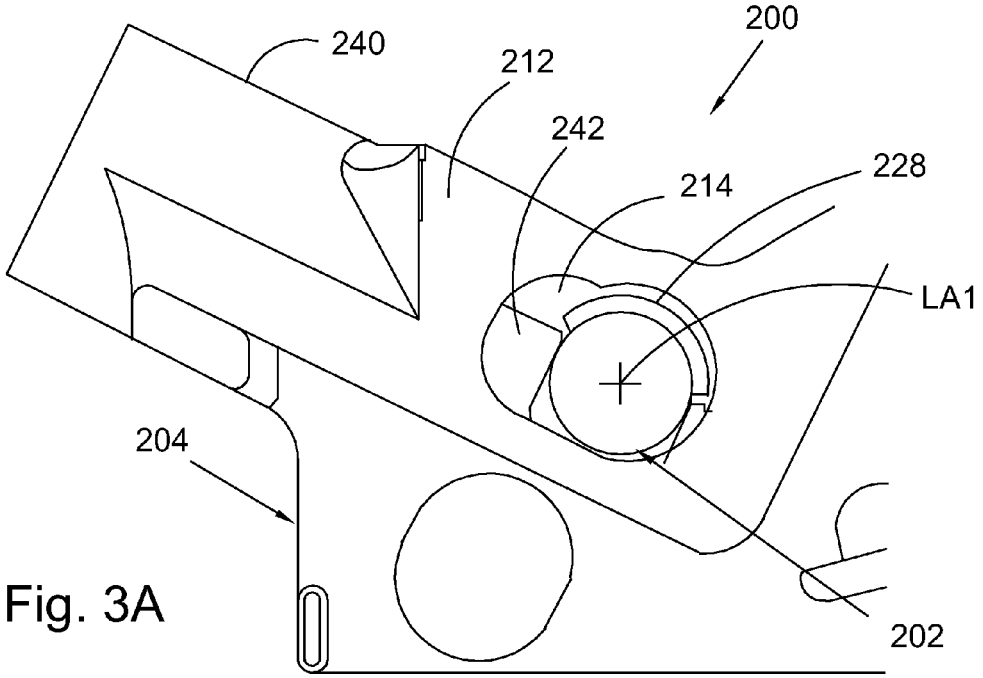
FIG. 3A is a partial side view of a switching roller finger follower with a locking pin being installed.

FIG. 3A is a partial side view of switching roller finger follower 200 with locking pin 202 being installed.

Figure 3B:
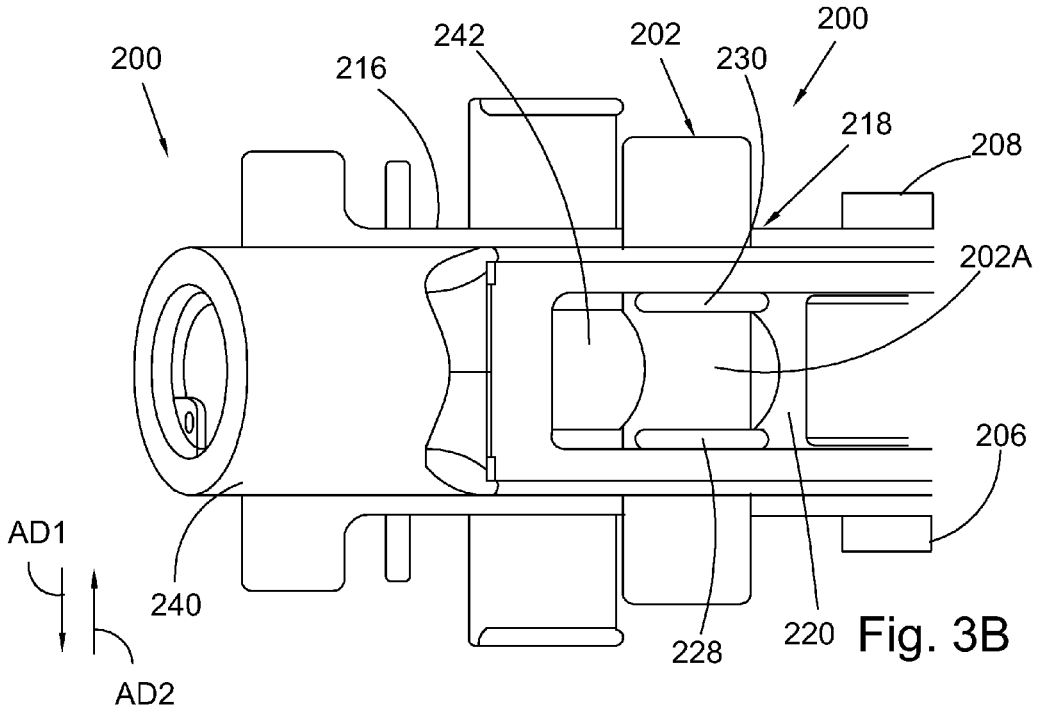
FIG. 3B is a partial top view of the switching roller finger follower in FIG. 3A fully extended in an axial direction.

FIG. 3B is a partial top view of switching roller finger follower 200 in FIG. 3A with locking pin 200 fully extended in axial direction AD1.

Figure 3C:
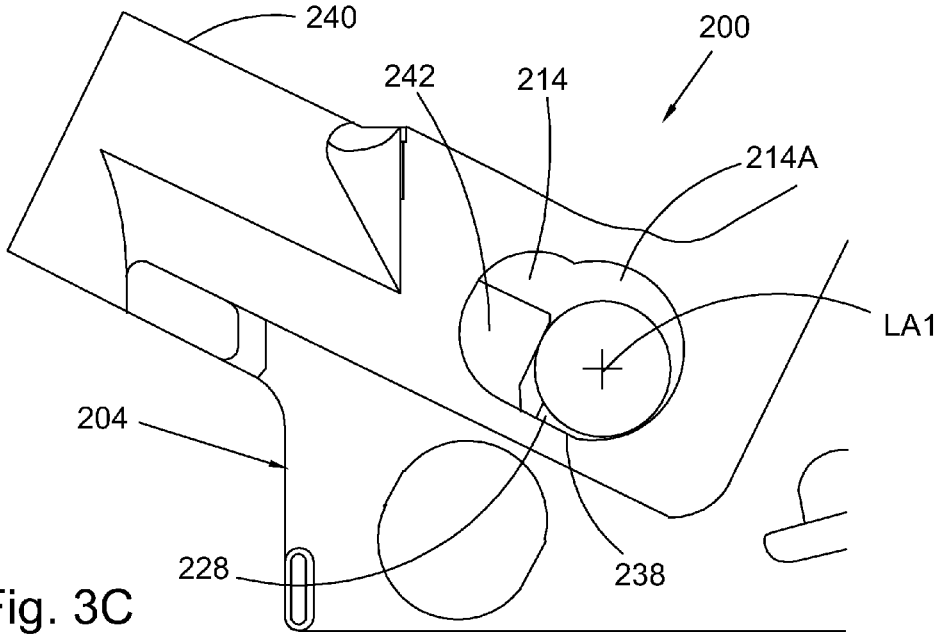
FIG. 3C is a partial side view of the switching roller finger follower in FIG. 3B with the locking pin rotated about 180 degrees.

FIG. 3C is a partial side view of switching roller finger follower 200 in FIG. 3B with locking pin 202 rotated about 180 degrees.

Figure 3D:
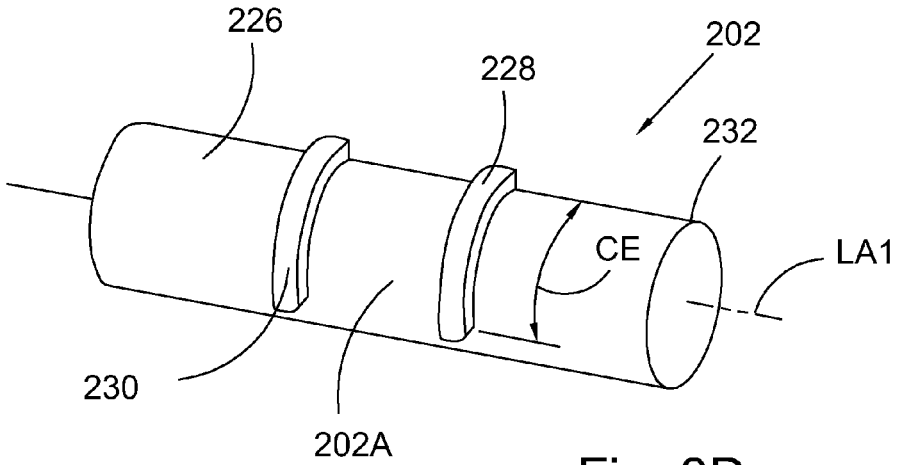
FIG. 3D is a perspective view of the locking pin in FIG. 3A.

FIG. 3D is a perspective view of locking pin 200 in FIG. 3A. The following should be viewed in light of FIGS. 3A through 3D. Follower 200 includes housing 204, outer arms 206 and 208, and pin 202. Housing 204 includes wall 212 with opening 214, wall 216 with opening 218, and interior space 220 at least partially formed by walls 212 and 216. Arms 206 and 208 are pivotably connected to walls 212 and 216, respectively. Pin 202 includes longitudinal axis LA1, body 226, and protrusions 228 and 230 extending radially from body 226 and disposed about at least respective portions of circumference 232 of the locking pin. The locking pin passes through openings 214 and 218 and includes portion 202A disposed in space 220. As shown in FIGS. 3B and 3C and further described below, when installed in the housing, respective portions of protrusions 228 and 230 are aligned with, or alignable with, walls 212 and 216 in directions AD1 and AD2. In the example embodiment of FIGS. 3A through 3D, openings 214 and 218 are wholly surrounded by walls 212 and 216, respectively, that is, openings 214 and 216 are wholly surrounded by respective material forming walls 212 and 216.

Protrusions 228 and 230 are integral to the locking pin, that is, the protrusions and body 226 are formed of a same single piece of material. At least one of protrusions 228 or 230 is located within space 220; or at least one of protrusions 228 or 230 is located outside of space 220. In the example of FIGS. 3A through 3C, both protrusion 228 and 230 are located within space 220, and aligned with walls 212 and 216 in directions AD1 and AD2.

In the example embodiment of FIGS. 3A through 3C, a circumferential extent CE of protrusions 228 and 230 (about the circumference of the locking pin) is less than 180 degrees and protrusions 228 and 230 are aligned in directions AD1/AD2.

At least one of openings 214 or 218 is sized to enable locking pin 202 and protrusions 228 and/or 230 to be inserted through the opening as shown in FIG. 3A. Because protrusions 228 and 230 only extent partly about the circumference of pin 202, portion 214A can be smaller than portion 114A in housing 104. Once pin 202 is inserted through opening 214 and 218, gravity holds pin 202 in contact with lower edges 238 of openings 214 and 218, for example, gravity rotates protrusion 228 radially downward. The alignment of protrusions 228 and 230 with walls 212 and 216, respectively, restrains pin 202 in directions AD1 and AD2. Specifically, alignment between protrusion 228 and wall 212 prevents movement of pin 202 in direction AD1, and alignment between protrusion 230 and wall 216 prevents movement of pin 202 in direction AD2.

In an example embodiment, housing includes locking barrel 240 and follower 200 includes shuttle pin 242, engaged with pin 202. According to the rotation of pin 202, protrusions 228 and 230 may be aligned with the shuttle pin in directions AD1 and AD2 to provide additional stability. As is known in the art, the locking pin is displaceable via displacement of the shuttle pin such that in a locked mode, the locking pin contacts arms 206 and 208 to block pivoting of arms 206 and 208. In an unlocked mode, the locking pin is displaceable via the shuttle pin such that pin 202 is free of contact with arms 206 and 208 and arms 206 and 208 are free to pivot.

Figure 4A:
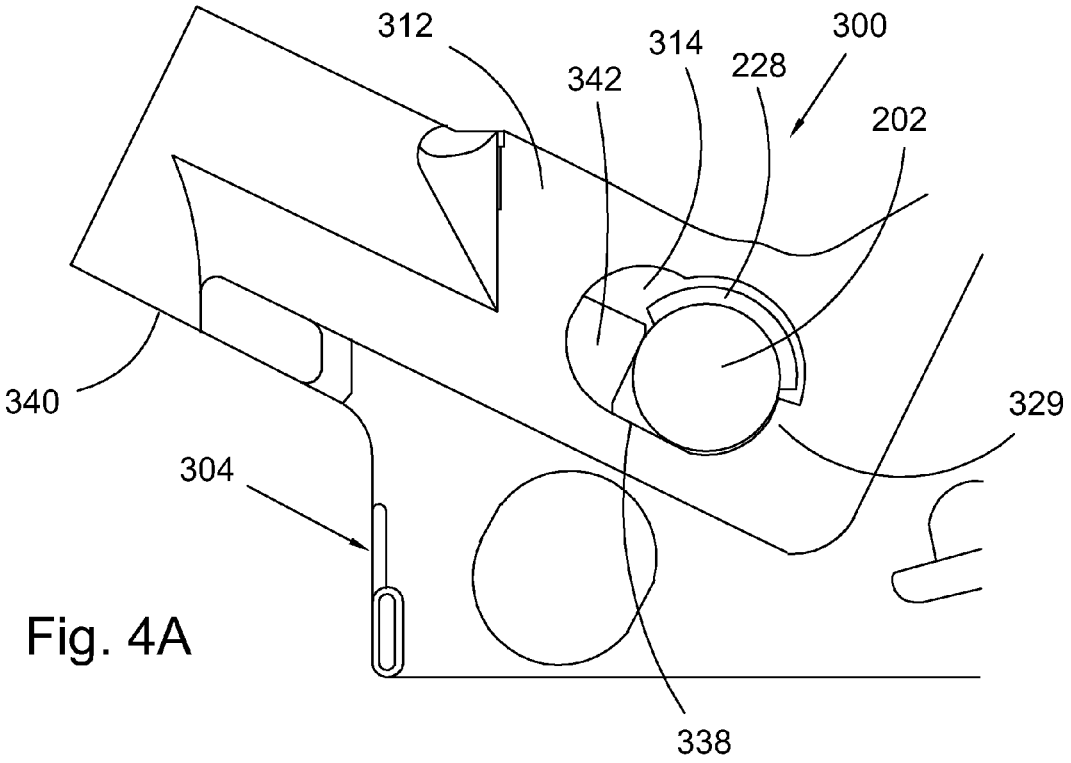
FIG. 4A is a partial side view of a switching roller finger follower with a locking pin being installed.

FIG. 4A is a partial side view of switching roller finger follower 300 with locking pin 202 being installed.

Figure 4B:
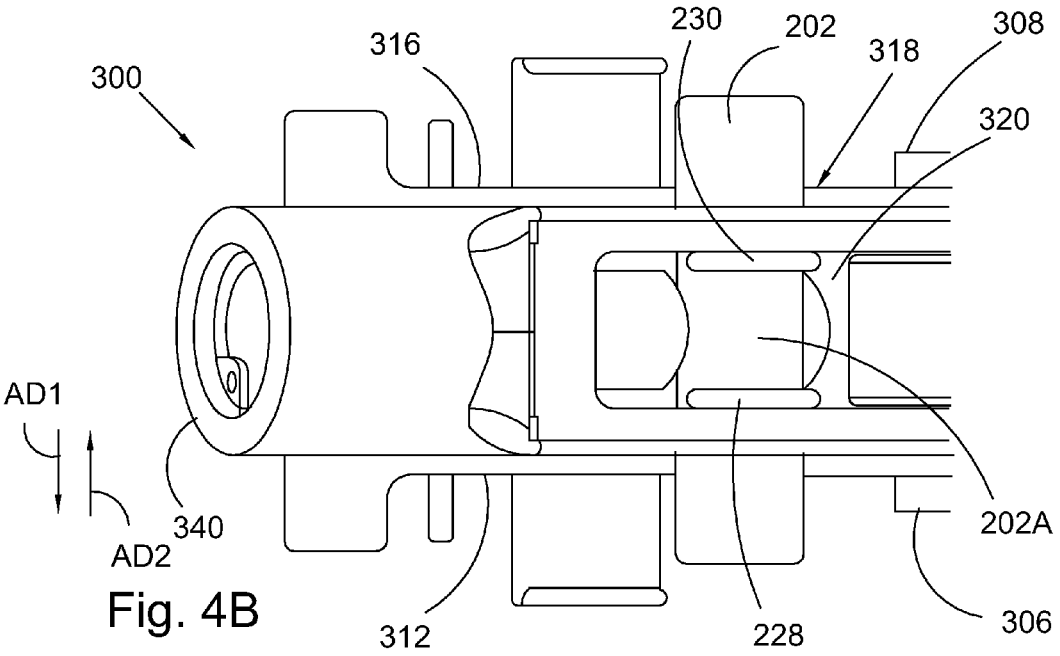
FIG. 4B is a partial top view of the switching roller finger follower in FIG. 4A fully extended in an axial direction.

FIG. 4B is a partial top view of switching roller finger follower 300 in FIG. 4A with pin 202 fully extended in axial direction AD1.

Figure 4C:
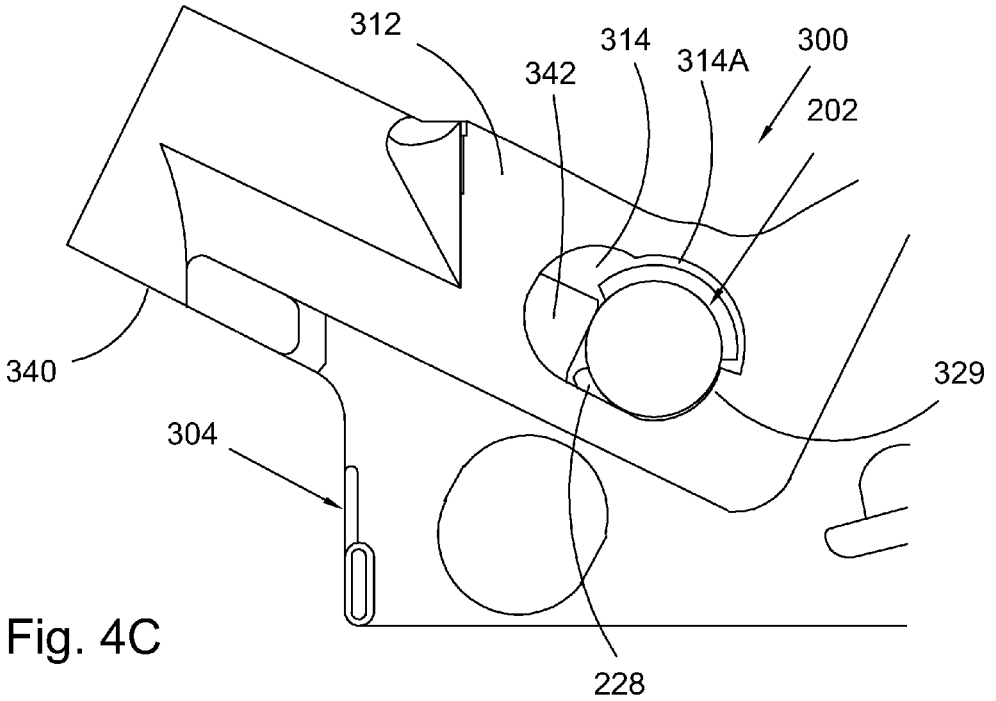
FIG. 4C is a partial side view of the switching roller finger follower in FIG. 4B rotated about 180 degrees.

FIG. 4C is a partial side view of switching roller finger follower in FIG. 4B with locking pin 202 rotated about 180 degrees. The following should be viewed in light of FIGS. 4A through 4C. Follower 300 includes housing 304, outer arms 306 and 308, and pin 202. Housing 304 includes wall 312 with opening 314, wall 316 with opening 318, and interior space 320 at least partially formed by walls 312 and 316. Arms 306 and 308 are pivotably connected to walls 312 and 316, respectively. Pin 202 passes through openings 314 and 318 and includes portion 202A disposed in space 320. When installed in the housing, respective portions of protrusions 228 and 230 are aligned with, or alignable with, walls 312 and 316 in directions AD1 and AD2. In the example embodiment of FIGS. 4A through 4C, openings 314 and 318 are wholly surrounded by walls 312 and 316, respectively, that is, openings 314 and 316 are wholly surrounded by respective material forming walls 312 and 316.

At least one of openings 314 or 318 is sized to enable locking pin 202 and protrusions 228 and/or 230 to be inserted through the opening. Because protrusions 228 and 230 only extent partly about the circumference of pin 202, portion 314A can be smaller than portion 114A in housing 104. Off-set 329 in openings 314 provides more secure retention of pin 202. A similar off-set (not shown) is part of opening 318.

Once pin 202 is inserted through opening 314 and 318, gravity holds pin 202 in contact with lower edges 338 of openings 314 and 318. The alignment of protrusions 228 and 230 with walls 312 and 316, respectively, restrains pin 202 in directions AD1 and AD2. Specifically, alignment between protrusion 228 and wall 212 prevents movement of pin 202 in direction AD1, and alignment between protrusion 230 and wall 216 prevents movement of pin 202 in direction AD2.

In an example embodiment, housing includes locking barrel 340 and follower 300 includes shuttle pin 342, engaged with pin 202. According to the rotation of pin 202, protrusions 228 and 230 may be aligned with the shuttle pin in directions AD1 and AD2 to provide additional stability. As is known in the art, the locking pin is displaceable via displacement of the shuttle pin such that in a locked mode, the locking pin contacts arms 306 and 308 to block pivoting of arms 306 and 308. In an unlocked mode, the locking pin is displaceable via the shuttle pin such that pin 202 is free of contact with arms 306 and 308 and arms 306 and 308 are free to pivot.

Figure 5A:
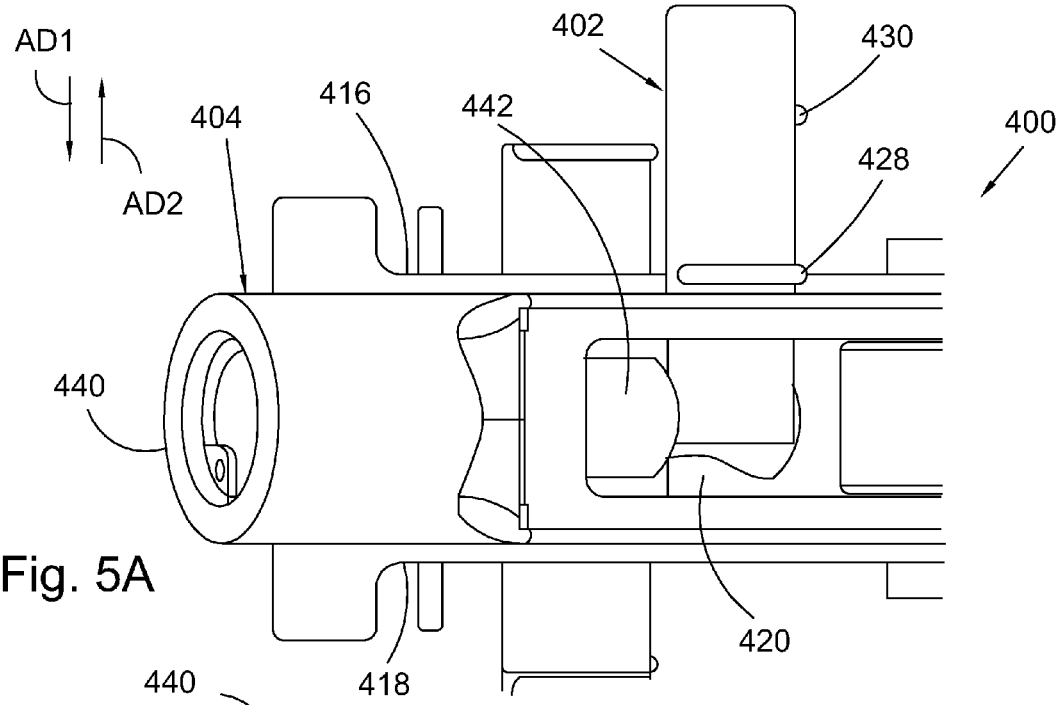
FIG. 5A is a partial top view of a switching roller finger follower showing initial installation of a locking pin.
Figure 5B:
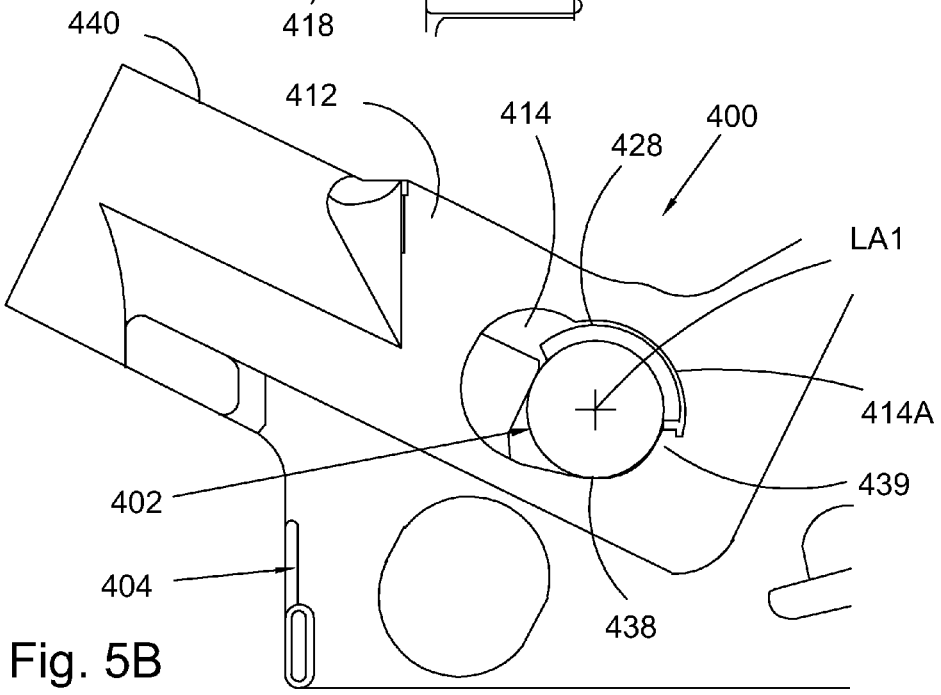
FIG. 5B is a partial side view of the switching roller finger follower in FIG. 5A with the locking pin fully extended in an axial direction.

FIG. 5A is a partial top view of switching roller finger follower 400 showing initial installation of locking pin 402;

FIG. 5B is a partial side view of switching roller finger follower 400 in FIG. 5A with locking 402 pin fully extended in axial direction AD1.

Figure 5C:
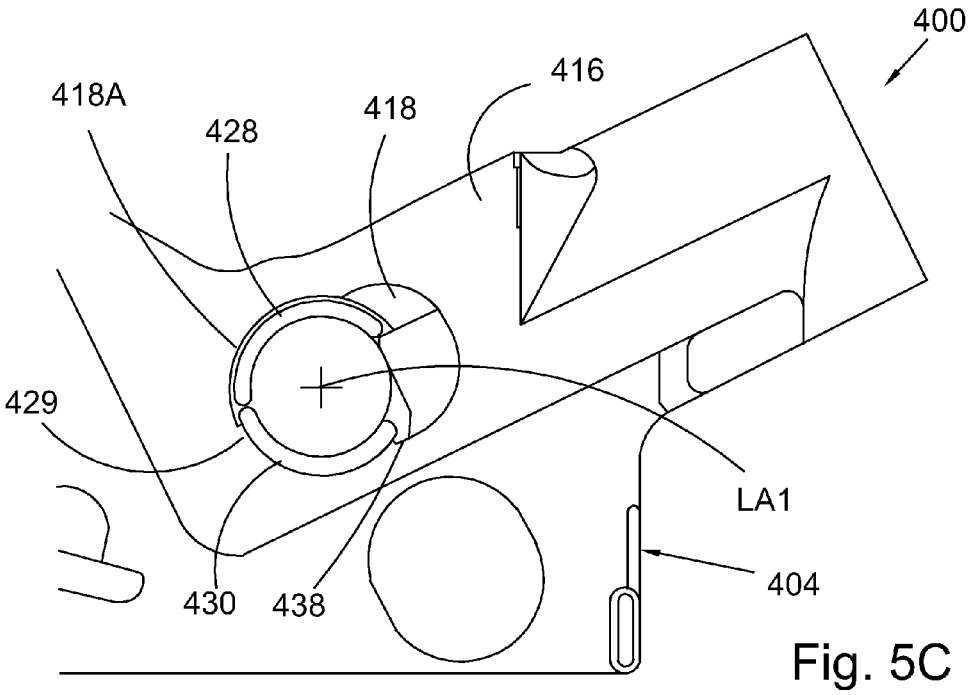
FIG. 5C is a partial side view of the switching roller finger follower in FIG. 5A with the locking pin in a final position.

FIG. 5C is a partial side view of switching roller finger follower 400 in FIG. 5A with locking pin 402 in a final position.

Figure 5D:
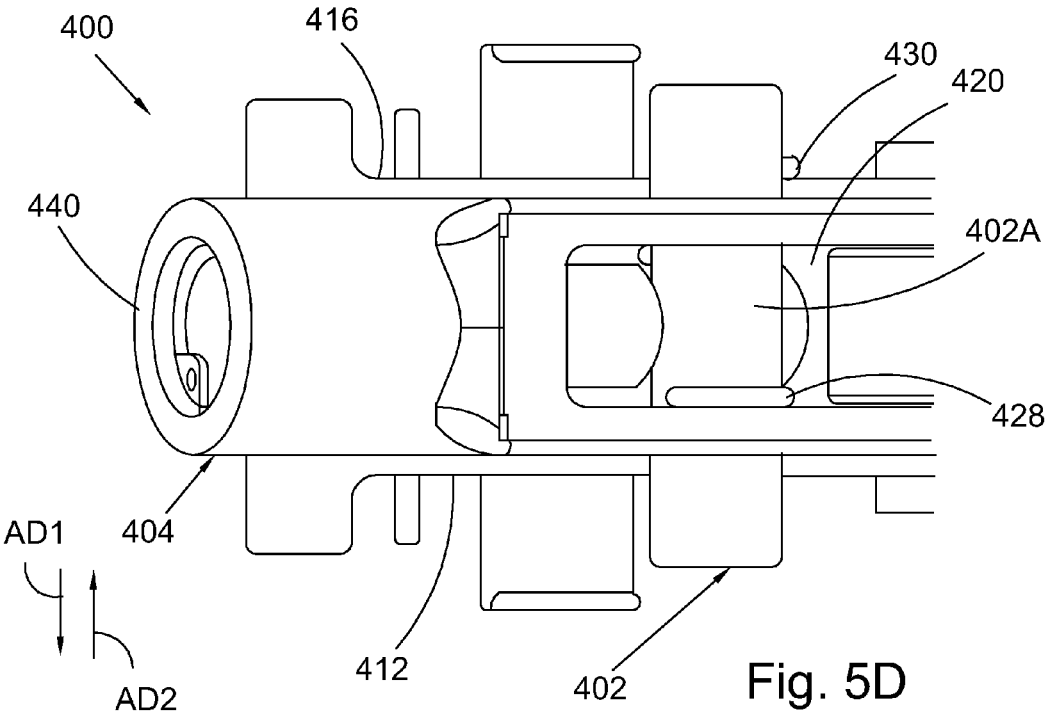
FIG. 5D is a partial top view of the switching roller finger follower in FIG. 5C.

FIG. 5D is a partial top view of switching roller finger follower 400 in FIG. 5C.

Figure 5E:
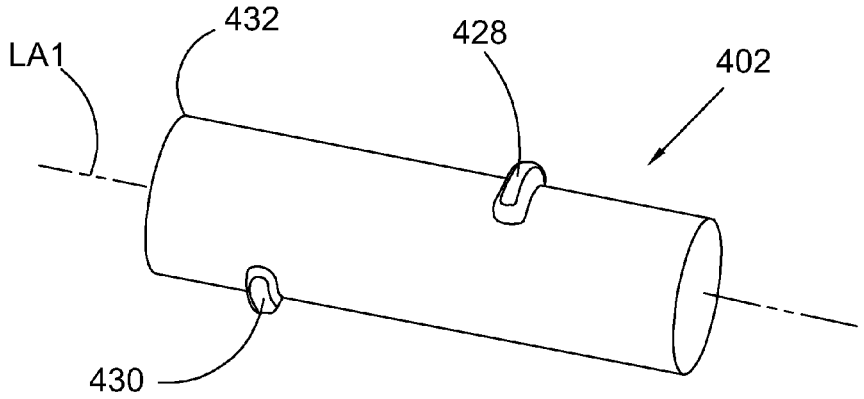
FIG. 5E is a perspective view of the locking pin in FIGS. 5A through 5D.

FIG. 5E is a perspective view of locking pin 402 in FIGS. 5A through 5D. The following should be viewed in light of FIGS. 5A through 5E. Follower 400 includes housing 404, outer arms 406 and 408, and pin 402. Housing 404 includes wall 412 with opening 414, wall 416 with opening 418, and interior space 420 at least partially formed by walls 412 and 416. Arms 406 and 408 are pivotably connected to walls 412 and 416, respectively. Pin 402 passes through openings 414 and 418 and includes portion 402A disposed in space 420. Pin 402 includes protrusions 428 and 430 extending from circumference 432 of the pin. In an example embodiment, at least respective portions of 428 and 430 are misaligned in a direction parallel to axis LA1. In an example embodiment, all of protrusions 428 and 430 are misaligned with each other in a direction parallel to axis LA1. When installed in the housing, respective portions of at least one of protrusions 428 or 430 is aligned with, or alignable with, walls 412 and 416 in directions AD1 and AD2. For example, in FIGS. 5C and 5D, protrusion 430 is aligned with wall 416. In the example embodiment of FIGS. 5A through 5D, openings 414 and 418 are wholly surrounded by walls 412 and 416, respectively, that is, openings 414 and 416 are wholly surrounded by respective material forming walls 412 and 416.

At least one of openings 414 or 418 is sized to enable locking pin 402 and protrusions 428 and/or 430 to be inserted through the opening. For example, portion 418A, similar to portion 414A, is sized to enable protrusion 428 to pass and enables off-set 429 to remain in place. Because protrusions 428 and 430 only extend partly about the circumference of pin 402, portions 414A and 418A can be smaller than portion 114A in housing 104. Off-set 429 in opening 418 provides more secure retention of pin 402 in direction AD1.

Once pin 402 is inserted through opening 414 and 418, gravity holds pin 402 in contact with lower edges 438 of openings 414 and 418. The alignment of protrusion 430 with wall 416 restrains pin 402 in direction AD1.

In an example embodiment, housing includes locking barrel 440 and follower 400 includes shuttle pin 442, engaged with pin 402. Protrusion 428 is sized and positioned such that at least a portion of protrusion 428 is aligned with shuttle pin 442, which restrains pin 402 in direction AD2. As is known in the art, the locking pin is displaceable via displacement of the shuttle pin such that in a locked mode, the locking pin contacts arms 406 and 408 to block pivoting of arms 406 and 408. In an unlocked mode, the locking pin is displaceable via the shuttle pin such that pin 402 is free of contact with arms 406 and 408 and arms 406 and 408 are free to pivot.

Figure 6A:
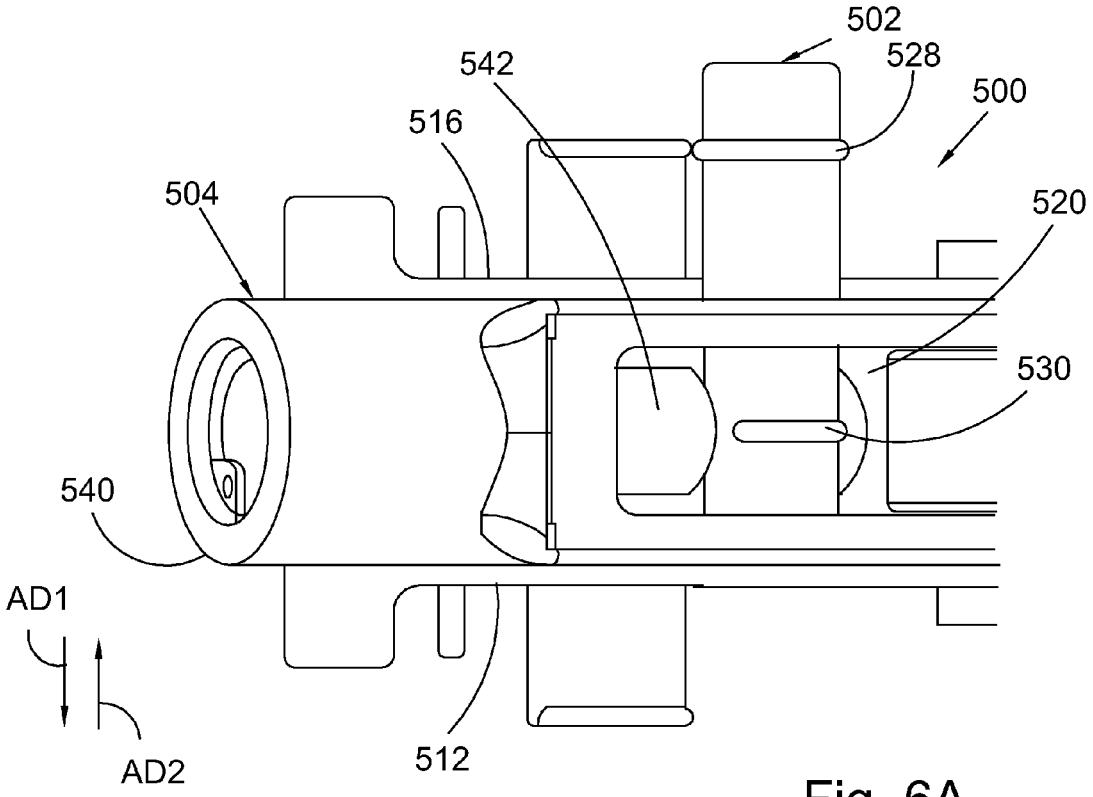
FIG. 6A is a partial top view of a switching roller finger follower showing a locking pin being installed.

FIG. 6A is a partial top view of switching roller finger follower 500 showing locking pin 502 being inserted.

Figure 6B:
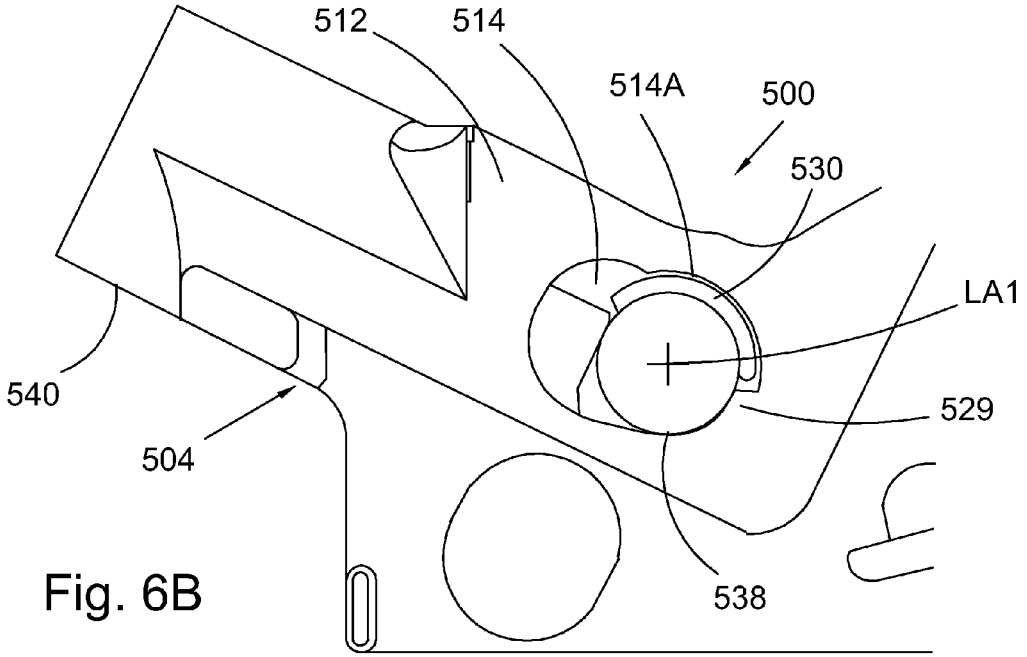
FIG. 6B is a partial side view of the switching roller finger follower in FIG. 6A.

FIG. 6B is a partial side view of switching roller finger follower 500 in FIG. 6A.

Figure 6C:
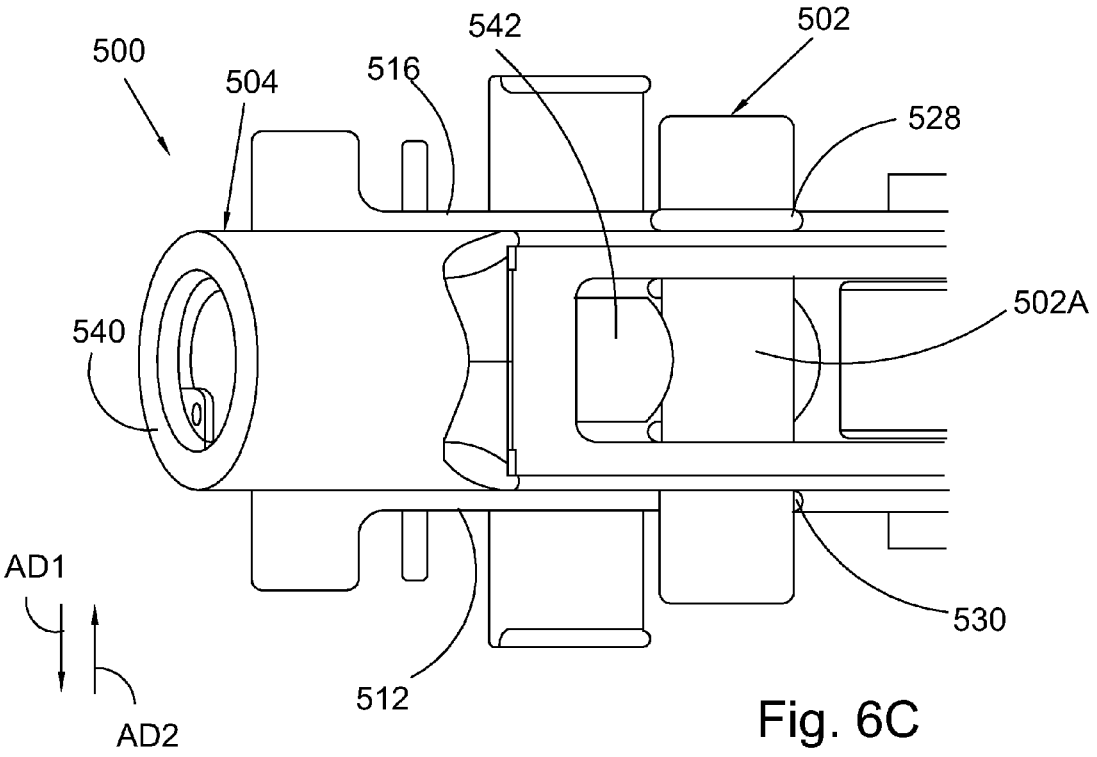
FIG. 6C is a partial top view of the switching roller finger follower in FIG. 6A with the locking pin in a final position.

FIG. 6C is a partial top view of switching roller finger follower 500 in FIG. 6A with locking pin 502 in a final position.

Figure 6D:
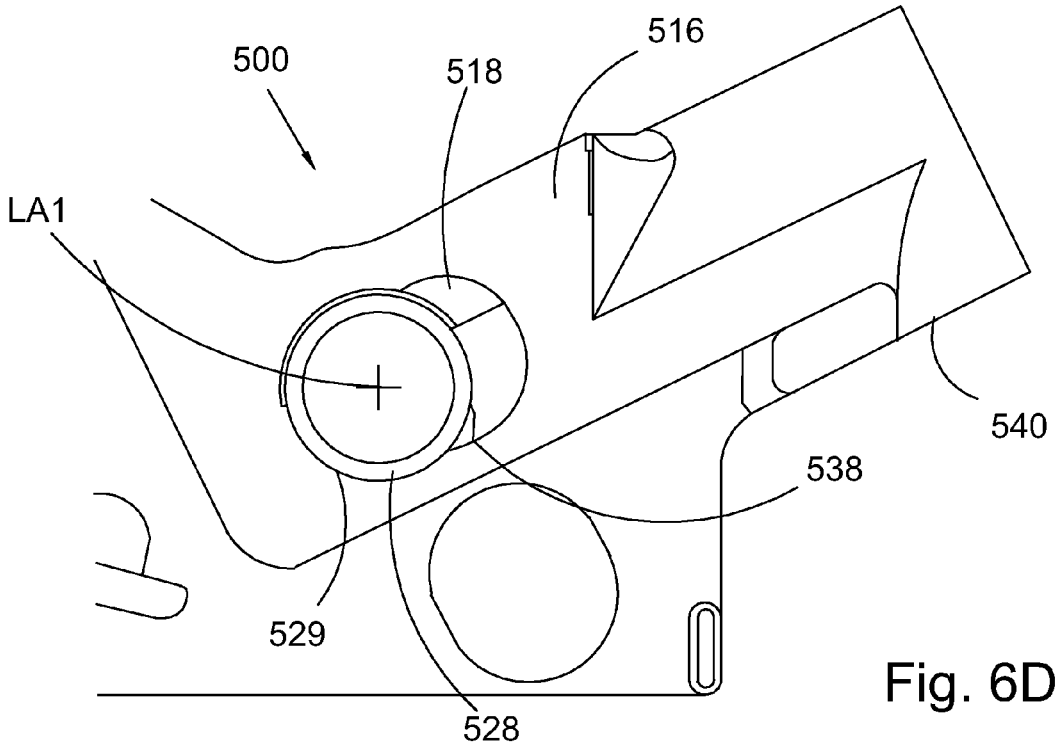
FIG. 6D is a partial side view of the switching roller finger follower in FIG. 6C; and, FIG. 6E is a perspective view of the locking pin in FIGS. 6A through 6D.

FIG. 6D is a partial side view of switching roller finger follower 500 in FIG. 5C.

Figure 6E:
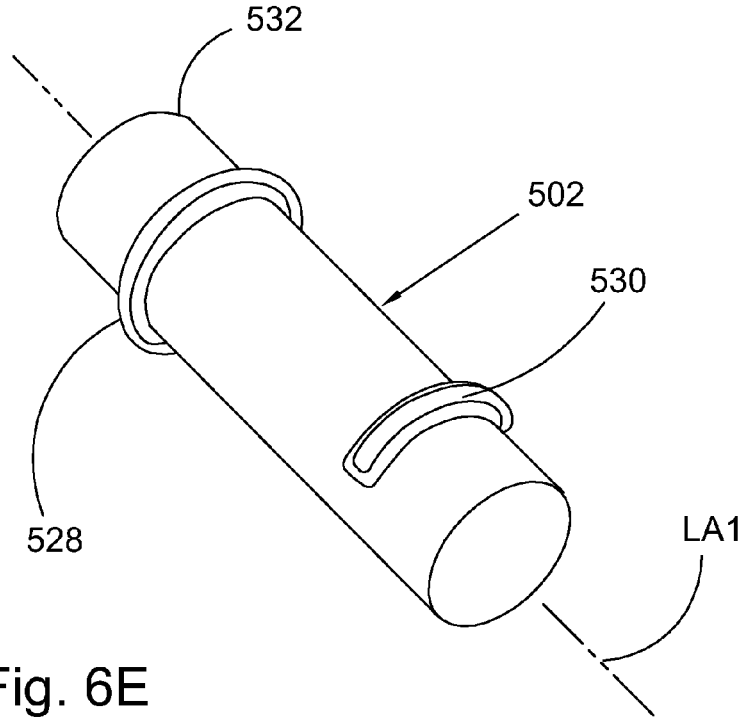

FIG. 6E is a perspective view of locking pin 502 in FIGS. 5A through 5D. The following should be viewed in light of FIGS. 5A through 5E. The following should be viewed in light of FIGS. 5A through 5E. Follower 500 includes housing 504, outer arms 506 and 508, and pin 502. Housing 504 includes wall 512 with opening 514, wall 416 with opening 518, and interior space 520 at least partially formed by walls 512 and 416. Arms 506 and 508 are pivotably connected to walls 512 and 516, respectively. Pin 502 passes through openings 514 and 518 and includes portion 503A disposed in space 520. Pin 502 includes protrusions 528 and 530 extending from circumference 532 of the pin. In an example embodiment, pin 528 extends about the entire circumference 532 and pin 530 extends only about a portion of circumference 532. When installed in the housing, respective portions of at least one of protrusions 528 or 530 are aligned with, or alignable with, walls 512 and 516 in directions AD1 and AD2. For example, in FIGS. 5C and 5D, protrusion 530 is outside of wall 512 and at least partially aligned with wall 512, and protrusion 528 is outside of wall 516 and at least partially aligned with wall 516. In the example embodiment of FIGS. 5A through 5D, openings 514 and 518 are wholly surrounded by walls 512 and 516, respectively, that is, openings 514 and 516 are wholly surrounded by respective material forming walls 512 and 516.

Opening 518 is sized to enable locking pin 502 and protrusion 530 to be inserted through the opening. For example, portion 518A is sized to enable protrusion 530 to pass while off-set 529 is in place. Because protrusion 530 only extends partly about the circumference of pin 502, portion 518A can be smaller than portion 114A in housing 104. Off-set 529 in opening 514 provides more secure retention of pin 502 in direction AD2. The full circumference of protrusion 528 provides maximum retention in direction AD1; however, since protrusion 528 does not need to pass through opening 518, 518 can be sized to fit only smaller protrusion 530.

Once pin 502 is inserted through opening 514 and 518, gravity holds pin 502 in contact with lower edges 538 of openings 514 and 518.

In an example embodiment, housing includes locking barrel 540 and follower 500 includes shuttle pin 542, engaged with pin 502. As is known in the art, the locking pin is displaceable via displacement of the shuttle pin such that in a locked mode, the locking pin contacts arms 506 and 508 to block pivoting of arms 506 and 508. In an unlocked mode, the locking pin is displaceable via the shuttle pin such that pin 502 is free of contact with arms 506 and 508 and arms 506 and 508 are free to pivot.

Advantageously, the respective configurations of followers 100 through 500 prevent the misalignment of respective locking pins, solving the problem noted above. In particular, respective protrusions on pins 102, 202, 302, and 502 are aligned with the sides of the followers and in some cases, shuttle pins for the followers, to block undesired axial displacement of the pins. In addition, circumferential extents of the various pins are advantageously configured to enhance the axial blocking while minimizing the size of the opening required for installation of the pin while increasing ease of installation. In general, minimizing the size of the opening enhances the axial blocking as well.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

The invention claimed is:

1. A switching roller finger follower for a valve train of an internal combustion engine, comprising:

a housing including:

a first wall with a first opening;

a second wall with a second opening; and, an interior space at least partially formed by the first and second walls;

first and second pivotable outer arms; and, a locking pin disposed in the first and second openings and including:

a first longitudinal axis;

a body; and, first and second protrusions:

extending radially outward from the body;

formed of a same single piece of material as the body; and, at least one of which is located within the interior space, wherein:

a respective portion of at least one of the first or second protrusions is aligned with the first or second wall in a direction parallel to the first longitudinal axis; and, the locking pin is displaceable such that:

in a locked mode, the locking pin contacts the first and second outer arms to block pivoting of the first and second outer arms in a rotational direction; and, in an unlocked mode, the locking pin is free of contact with the first and second outer arms.

2. The switching roller finger follower of claim 1, wherein:

a respective circumferential extent of each of the first and second protrusions is less than 180degrees.

3. The switching roller finger follower of claim 1, wherein:

a respective circumferential extent of each of the first and second protrusions is greater than 180 degrees.

4. The switching roller finger follower of claim 1, wherein:

at least a portion of the first protrusion is misaligned with the second protrusion in the direction.

5. The switching roller finger follower of claim 1, wherein:

the first and second protrusions are wholly misaligned in the direction.

6. The switching roller finger follower of claim 1, wherein:

each of the first and second protrusions is disposed within the interior space.

7. The switching roller finger follower of claim 1, wherein:

one of the first and second protrusions is disposed within the interior space; and, the other of the first and second protrusions is disposed outside of the housing.

8. The switching roller finger follower of claim 1, wherein:

each of the first and second protrusions is disposed outside of the housing.

9. The switching roller finger follower of claim 1, wherein:

a circumferential extent of the first protrusion is 360 degrees; and, a circumferential extent of the second protrusion is less than 360 degrees.

10. The switching roller finger follower of claim 1, wherein:

each of the first and second protrusions is aligned with the first or second wall in the direction parallel to the first longitudinal axis.

11. The switching roller finger follower of claim 1, wherein:

the locking pin is insertable into the space through the first or second opening.

12. The switching roller finger follower of claim 1, wherein:

the first opening is wholly surrounded by first material forming the first wall; and, the second opening is wholly surrounded by second material forming the second wall.

13. The switching roller finger follower of claim 1, wherein:

the housing includes a locking barrel, the switching roller finger follower further comprising:

a shuttle pin disposed in the locking barrel and the space and engaged with the locking pin, wherein:

at least one of the first or second protrusions is aligned with the shuttle pin in the direction parallel to the first longitudinal axis.

14. A switching roller finger follower for a valve train of an internal combustion engine, comprising:

a housing including:

a first wall with a first opening wholly surrounded by the first wall;

a second wall with a second opening wholly surrounded by the second wall; and, an interior space at least partially formed by the first and second walls;

first and second pivotable outer arms; and, a locking pin disposed in the interior space and in first and second openings and including:

a first longitudinal axis;

a body; and, first and second protrusions:

extending radially outward from the body; and, formed of a same single piece of material as the body; and, at least one of which is located within the interior space or outside of the first or second wall with respect to the space, wherein:

a respective portion of one of the first or second protrusions is aligned with the first or second wall in a direction parallel to the first longitudinal axis; and, the locking pin is displaceable such that:

in a locked mode, the locking pin contacts the first and second outer arms to block pivoting of the first and second outer arms in a rotational direction; and, in an unlocked mode, the locking pin is free of contact with the first and second outer arms.

15. A method of fabricating a switching roller finger follower for a valve train of an internal combustion engine, comprising:

forming a housing including:

a first wall with a first opening;

a second wall with a second opening; and, an interior space at least partially formed by the first and second walls;

pivotably connecting first and second outer arms to the housing;

forming, of one only single piece of material, a locking pin including:

a first longitudinal axis;

a body; and, first and second protrusions extending radially outward from the body;

inserting the locking pin through the first and second openings; and, aligning respective portions of at least one of the first or second protrusions with the first and second walls in an axial direction parallel to the first longitudinal axis, wherein:

the locking pin is displaceable such that:

in a locked mode, the locking pin contacts the first and second outer arms to block pivoting of the first and second outer arms in a rotational direction; and, in an unlocked mode, the locking pin is free of contact with the first and second outer arms.

16. The method of claim 15, wherein forming a locking pin with first and second protrusions includes:

forming a respective circumferential extent of each of the first and second protrusions to be less than 180 degrees; or, forming a respective circumferential extent of each of the first and second protrusions to be greater than 180 degrees.

17. The method of claim 15, wherein forming a locking pin with first and second protrusions includes:

forming at least a portion of the first protrusion to be misaligned with the second protrusion in the axial direction.

18. The method of claim 15, wherein forming a locking pin with first and second protrusions includes:

forming the first and second protrusion to be wholly misaligned in the axial direction; or, locating each of the first and second protrusions within the interior space.

19. The method of claim 15, further comprising:

locating only one of the first or second protrusions within the interior space.

20. The method of claim 15, further comprising:

locating each of the first and second protrusions outside of the housing.

* * * * *